US005450673A

United States Patent [19]

Denton

[11] Patent Number: 5,450,673

[45] Date of Patent: Sep. 19, 1995

[54] ROTATING DISK PEEP SIGHT SYSTEM

[76] Inventor: Don Denton, 37054 Ave. 17½, Madera, Calif. 93638

[21] Appl. No.: 234,308

[22] Filed: Apr. 28, 1994

[51] Int. Cl.[6] ..... F41G 1/467

[52] U.S. Cl. ..... 33/265; 124/87

[58] Field of Search ..... 33/265; 124/87

[56] References Cited

U.S. PATENT DOCUMENTS

| | | | |
|---|---|---|---|
| 4,454,857 | 3/1984 | Miller | 124/87 |
| 4,656,746 | 4/1987 | Gillespie | 33/265 |
| 5,107,596 | 4/1992 | Snyder | 33/265 |

*Primary Examiner*—Christopher W. Fulton

[57] ABSTRACT

Rotating Disk Peep Sight System comprising a round disk (10) with a hole (20) punched in the center sized to receive a bow string (18). The disk (10) has one or more symmetric holes (12) punched near the rim (34). The disk (10) and holes (12) are horizontal when the bow (36) is in a braced position with the bow string (18) vertical. When the bow (36) is drawn the disk (10) is very close to the archer's eye and the disk (10) is tilted revealing to the archer's eye, sighting openings through the holes (12) punched near the rim (34) of the disk (10). Retaining rings (14) or some other stabilizing device will be installed above and below the disk (10) to hold it in place and to space the sighting holes (12) a distance from the string. The disk (10) and rings (14) can be installed with or without a base (16) underneath. An aligning system (tag-line type system) prevents the disk (10) and string (18) from rotating during the draw, hold, and throughout the complete release. The aligning system consists of aligning pins (22) and elastic cord (28), and the elastic cord (28) remains under tension at all times.

19 Claims, 1 Drawing Sheet

ROTATING DISK PEEP SIGHT SYSTEM

BACKGROUND—FIELD OF INVENTION

This invention relates to archery. It is an archery bow peep sight attached to a bowstring, and used as a rear sight on an archery bow.

BACKGROUND—DESCRIPTION OF PRIOR ART

Pro-shops and mail order houses supply consumers with many different models of peep sights.

The archery bow helped separate mankind physically from his prey and enemies about 12,000 years ago. Archery bows began to lose popularity after the invention of firearms. Firearms had more range, accuracy, and killing power. Firearm technologies became so advanced that hunting skill began to have little to do with hunting. Firearms took people away from the knowledge of nature, thus nature itself. The archery bow has increased in popularity lately for two reasons. The first reason is the arrival of the compound bow. The second is that guns are becoming the scapegoat for the exploding crime wave. The compound bow allows an archer to be able to shoot larger bows more accurately. Originally arrows were shot instinctive by setting them on the archer's fist or a shelf. One development that creates interest is a peep sight. The peep sight is a device that mounts on a bowstring above the nocked arrow. The peep sight is used as a rear bow sight for aiming an arrow.

In the 1970's the peep sight was developed. U.S. Pat. No. 4,454,857 to Miller (1984) discloses a wheel type peep sight. The wheel has an elongated hollow hub to receive the bow string, and spokes connecting the hub to a rim. The sighting openings are formed between the hub and the rim. The wheel type peep sight has spokes and the string does not remain at the same rotation every shot thus changing the sight picture slightly. The sight picture formed by the rim, hub, and spokes are not symmetric. The sight picture on the wheel type peep sights starts within ⅛" of the string.

Other disadvantages of the above type peep sight are:

(a) It does not have an aligning system to keep the string and sight from rotating during draw, hold, and release.

(b) The sight picture starts near the string thus the space between the string and the archer's face has not been extended when the bow is drawn.

(c) It cannot change the size of the sight picture by a simple rotation.

(d) It cannot be made into multiple sights for different distances.

SUMMARY OF THE INVENTION

Rotating Disk Peep Sight System

A rotating disk peep sight consisting of a round disk with a hole punched in the center sized to receive a bowstring. The disk has one or more symmetric holes punched near the rim. The disk and holes are horizontal when the bow is in a braced position with the bow string vertical. When the bow is drawn the sight is very close to the archer's eye and the disk is tilted revealing to the archer's eye, sighting openings through the holes punched near the rim of the disk. Retaining rings or some other stabilizing means will be installed above and below the disk to hold it in place and to space the sighting holes a distance from the string. The disk and rings can be installed with or without a base underneath. An aligning system (tag-line type system) prevents the disk and string from rotating during the draw, hold, and throughout the complete release. The aligning and stabilizing system consists of an elastic cord or band attached to the string by a pin or clamp, or just looped to it. The other end of the elastic cord or band is attached to the bow handle or some component on the bow handle. In order for the aligning system to prevent the sight and string from rotating during the complete release, it is under tension at all times, when the bow is drawn, when the bow is in brace position, and during the complete release. Another elastic cord or band can be installed by looping it around the string below the arrow nocking point or by securing it to an aligning pin. The elastic cord or band is attached to the bow handle or some component on it, to keep vibration from jarring the sight out of position. By preventing the string and sight from turning during the complete release help stabilize the string and help stop vibration and noise. A pin can be inserted in the disk to lock it in place.

ACCORDINGLY OTHER OBJECTS AND ADVANTAGES OF MY INVENTION ARE:

(a) The sighting holes can be spaced further from the string making it easier to draw the bow back further, and leaving more room for a thumb release.

(b) Sighting holes spaced from the string makes it easier to use the Mongolian style release.

(c) Sighting holes spaced from the string on a large disk makes multiple peep sights possible, for different ranges.

(d) The sight picture will be symmetric.

(e) The rotating assembly can be produced from rubber to serve as a string silencer.

(f) The aligning systems under tension at all times help stabilize string, and thus bow during release.

FURTHER OBJECTS AND ADVANTAGES ARE:

The extra space from string to sight makes using releases made for Mongolian style shooting easier to use. The string can be drawn back further, adding more energy to the released arrow.

DRAWING FIGURES

REFERENCE NUMERALS IN DRAWING

| | |
|---|---|
| 10. = disk | 28. elastic cord |
| 12. = peep sight holes | 30. disk peep sight assembly |
| 14. = retaining ring | 32. nocking ring |
| 16. = base | 34. rim of disk |
| 18. = bow string | 36. bow |
| 20. = string receiving holes | 38. arrow rest |
| 22. = aligning system pin | 21. bow stabilizer |
| 24. = bow handle | |
| 26. = arrow | |

DESCRIPTION—FIGS. 1 TO 6C

Figure 1:
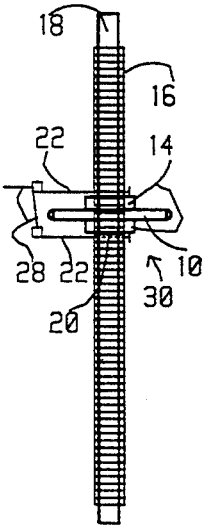
FIG. 1 Is a perspective view of this peep sight assembly in preferred embodiment.

A typical embodiment of the disk peep sight assembly 30 of the present invention is illustrated in FIG. 1. The sight assembly 30 is attached to the bowstring 18 over base 16 through receiving hole 20. The base 16 is a serving. The disk 10 is held in place by securing rings 14 both above and below it. Below and above the disk peep sight assembly 30 are the aligning system pins 22 with the elastic cord 28 attached to them. The pins 22 align, stabilize, and hold sight assembly 30 at the correct elevation on bow string 18.

Figure 2:
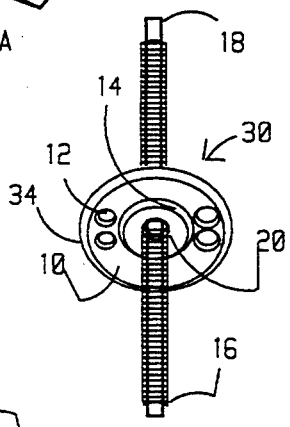
FIG. 2 illustrates a rear elevation view attached to a drawn bow string.

FIG. 2 shows the disk peep sight assembly 30 after the bow string 18 has been drawn. The sight assembly 30 is near the archer's eye when the string 18 is drawn. The disk 10 is tilted revealing to the archer's eye, the peep sighting holes 12.

Figure 3:
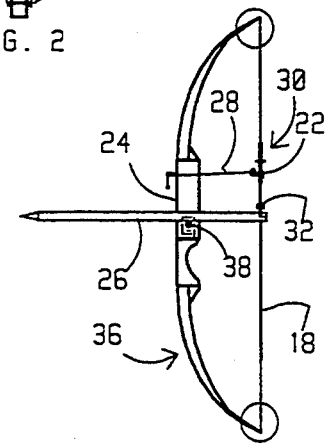
FIG. 3 illustrates the peep sight on a bow in the brace position.

FIG. 3 illustrates the rotating peep sight system on an archery bow 36 in the braced condition. It shows the elastic cord 28 attached to the aligning pin 22 on one end and attached to a component on the bow handle 24 on its other end. FIG. 3 shows the string 18 vertical in the braced condition. FIG. 3 also shows the tension on the aligning elastic cord 28 when the bow 36 is in the braced condition.

Figure 4:
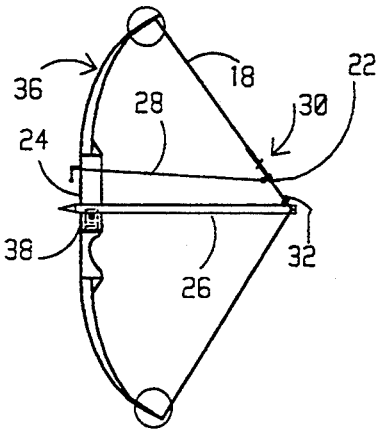
FIG. 4 illustrates the peep sight on a bow in the drawn position.

FIG. 4 illustrates the rotating peep sight system when the bow 36 is drawn. It shows that the disk 10 is tilted. It also shows the aligning pin 22 and elastic cord 28 holding the disk 10 in correct alignment.

Figure 5A:
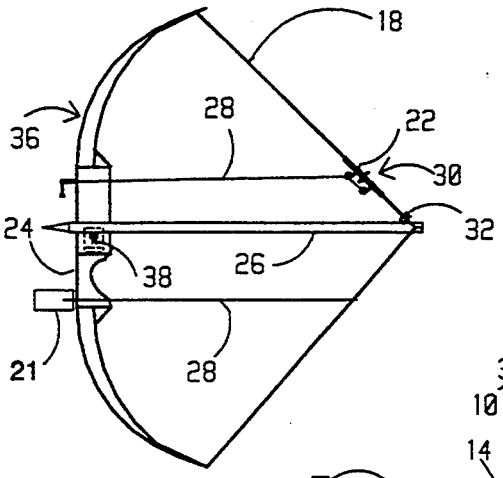
FIG. 5A and 5B illustrate different arrangements of aligning systems.
Figure 5B:
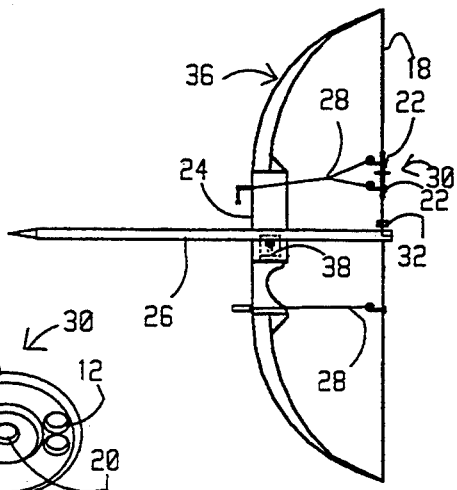

FIG. 5A and 5B illustrate ramifications of positions for alignment pins 22 and elastic cords 28. The pins are pressed through the string then a hook is formed on the end using needle nose pliers.

Figure 6C:
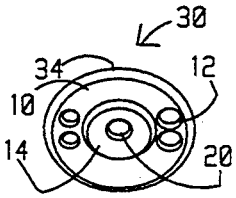
FIG. 6A to 6C illustrates different arrangements of the sighting holes.
Figures 6A, 6B:
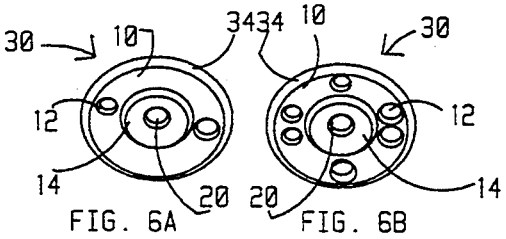

FIG. 6A to 6C illustrate ramifications of sighting holes 12 in disk 10.

OPERATION—FIGS. 3, and 4,

Using the rotating disk peep sight system FIG. 3 an archer nocks an arrow 26 on the bow string 18 at the nocking ring 32. The archer sets the arrow 26 on the arrow rest then draws the bow string 18 back near his/her face FIG. 4. The archer then sights the target through the sighting holes 12 in the disk 10. The forward bow sight pin is centered in the sighting hole 12 then placed on the target. The bowstring is then released.

SUMMARY, RAMIFICATIONS, AND SCOPE

Accordingly, the user will see that my rotating peep sight system is easy to use. Sighting holes spaced from the string helps stop face contact with the string. It allows the string to be drawn back further. The distance from the string makes the Mongolian type release easier to execute. The sighting holes are symmetric.

The descriptions above contain many specificities. These should not limit the scope of the invention, but merely provide illustrations of some of the presently preferred embodiments of this invention. For example, the aligning system can be installed both above and below the sight, and below the arrow. The aligning system keeps the hand that releases the arrow from turning the string. The aligning system also keeps the string from turning throughout the release of an arrow even after arrow has parted from the string. The aligning system under tension at all times acts as a tag-line, stabilizing the sight and string, thus bow throughout release. Stabilizing the string prevents the sight being jared out of position. The scope of the invention should be determined by the appended claims and their legal equivalents, rather than by the examples given.

I claim:

1. A rotating disk peep sight system for aiming an archery bow when shooting an arrow, said archery bow having a forward bow sight, a bow handle and a bow string, said rotating disk peep sight system comprising:

a mounting base; a disk; disk retaining rings; sight aligning and stabilizing means;

a means to attach said mounting base to a bowstring, located to receive said rotating disk peep sight system, positioned to form a rear bow sight for said archery bow; the improvements wherein said disk is sized to contain symmetric sighting holes of different sizes and groups spaced from said string, said sight aligning and stabilizing means align said sighting holes for shooting and help prevent said disk from being jerked out of position during the release of said arrow said sighting holes spaced from said string help prevent face from touching said string during release of said arrow, allowing said arrow to be drawn back further.

2. The rotating disk peep sight system of claim 1 wherein said mounting base comprise a serving line adapted to be secured to said bowstring, said mounting base receives said disk, said disk retaining rings, and said sight aligning and stabilizing means.

3. The rotating disk peep sight system of claim 2 wherein said sight aligning and stabilizing means comprising: a set of one or more aligning pins pressed through said mounting base and said bow string, above and below said disk and said disk retaining rings, and said pins are attached to a component on said bow handle by an elastic means.

4. The rotating disk peep sight system of claim 3 wherein said one or more of said elastic means are attached to said string below said arrow nocking point, and to a component on said bow handle on the other end.

5. The rotating disk peep sight system of claim 3 wherein said elastic means remains under tension at all times.

6. The rotating disk peep sight system of claim 5 wherein said elastic means is an elastic band.

7. The rotating disk peep sight system of claim 1 wherein said disk retaining rings are a disk with a hole in its center.

8. The rotating disk peep sight system of claim 1 wherein said disk has sets of said sighting holes to be used for multiple ranges.

9. A rotating disk peep sight system for aiming an archery bow when shooting an arrow, said archery bow having a forward bow sight, a bow handle and a bow string, said rotating disk peep sight system comprising: a mounting base; a disk; disk retaining rings; sight aligning and stabilizing means; a means to attach said mounting base to a bowstring, located to receive said rotating disk peep sight system, positioned to form a rear bow sight, for said archery bow; the improvements wherein said disk is sized to contain symmetric sighting holes of different sizes and sets spaced from said string, said sight aligning and stabilizing means align sight system for shooting and prevent said disk from being jerked out of position during the release of said arrow; said sighting holes spaced from said bow string assists in making a thumb release of said bowstring.

10. The rotating disk peep sight system of claim 9 wherein said mounting base comprise a serving line adapted to be secured to said bowstring, said mounting base receives and helps secure said disk, said stabilizing and alignment means, and said disk retainer rings.

11. The rotating disk peep sight system of claim 9 wherein said stabilizing and aligning means comprises a set of one or more aligning pins pressed through said mounting base and said bow string in the direction of said bow handle, near said disk and disk retainer rings, and said pins are attached to a component on said bow handle by an elastic means.

12. The rotating disk peep sight system of claim 11 wherein said one or more said elastic means is connected directly to said bow string below said arrow with its other end attached to a component on said bow handle.

13. The rotating disk peep sight system of claim 11 wherein said elastic means remains under tension at all times.

14. The rotating disk peep sight system of claim 9 wherein said retaining rings are comprised of a rubber disk smaller than said disk containing said sighting holes with a hole punched in the center to receive said bow string.

15. The rotating disk peep sight system of claim 9 wherein said sets of sighting holes to be used for multiple ranges and said single holes of different sizes change the size of the sight picture.

16. A rotating disk peep sight system for aiming an archery bow when shooting an arrow, said archery bow having a forward bow sight, a bow handle and a bow string, said rotating disk peep sight system comprising:

a mounting base; a disk; disk retaining rings; a sight aligning and stabilizing means;

a means to attach said mounting base to a bowstring, located to receive said rotating disk peep sight system, positioned to form a rear bow sight, for an archer shooting an archery bow; the improvements wherein said disk extends from said bow string, said disk is sized to contain symmetric sighting holes of different sizes and alignments spaced from said string, said aligning and stabilizing means align said disk for shooting and keeps said string stabilized at all times to help prevent said disk from jarring out of the correct position on said string.

17. The rotating disk peep sight system of claim 16 wherein said mounting base comprises a platform adapted to be secured to said bow string, said mounting base receives and helps secure said disk, said stabilizing and aligning means, and said disk retainer rings.

18. The rotating disk peep sight system of claim 16 wherein said stabilizing and aligning means comprises a means to lock on said bow string with an extended arm that is attached to said bow handle by an elastic means.

19. The rotating disk peep sight system of claim 16 wherein said elastic means remain under tension at all times.

* * * * *